US011563294B2

(12) United States Patent
Kisling

(10) Patent No.: US 11,563,294 B2
(45) Date of Patent: Jan. 24, 2023

(54) SPRING-LOADED INTERCONNECTS HAVING PRE-CONFIGURED FLEXIBLE CABLE

(71) Applicant: Corning Optical Communications RF, LLC, Glendale, AZ (US)

(72) Inventor: Brian Lyle Kisling, Youngtown, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 69 days.

(21) Appl. No.: 17/327,558

(22) Filed: May 21, 2021

(65) Prior Publication Data

US 2021/0367384 A1 Nov. 25, 2021

Related U.S. Application Data

(60) Provisional application No. 63/029,233, filed on May 22, 2020.

(51) Int. Cl.

| | |
|---|---|
| ***H01R 13/72*** | (2006.01) |
| ***H01R 13/502*** | (2006.01) |
| ***H01R 13/03*** | (2006.01) |

(52) U.S. Cl.

CPC ..... *H01R 13/72* (2013.01); *H01R 13/03* (2013.01); *H01R 13/502* (2013.01)

(58) Field of Classification Search

CPC ..... H01R 13/72; H01R 13/03; H01R 13/502
See application file for complete search history.

(56) References Cited

U.S. PATENT DOCUMENTS

| | | | | |
|---|---|---|---|---|
| 5,196,789 | A | 3/1993 | Golden et al. | |
| 5,329,262 | A | 7/1994 | Fisher | |
| 5,936,421 | A | 8/1999 | Stowers et al. | |
| 5,982,187 | A | 11/1999 | Tarzwell | |
| 6,053,777 | A | 4/2000 | Boyle | |
| 6,379,183 | B1 | 4/2002 | Ayres et al. | |
| 6,652,326 | B2 * | 11/2003 | Boyle | G01R 1/06722 439/700 |
| 6,734,689 | B1 | 5/2004 | Yang | |
| 6,824,415 | B2 | 11/2004 | Wlos | |
| 6,921,299 | B2 * | 7/2005 | McMaster | H01R 9/05 439/700 |

(Continued)

FOREIGN PATENT DOCUMENTS

| | | | |
|---|---|---|---|
| CN | 101656383 | B | 11/2012 |
| EP | 2027630 | B1 | 12/2016 |

(Continued)

*Primary Examiner* — Abdullah A Riyami
*Assistant Examiner* — Nader J Alhawamdeh
(74) *Attorney, Agent, or Firm* — Tamika A. Crawl-Bey

(57) ABSTRACT

A spring-loaded interconnect includes a forward interconnect subassembly and a rearward interconnect subassembly with a flexible cable extending between each subassembly. The flexible cable includes a plurality of curved sections, and a plurality of substantially straight sections integral with the plurality of curved sections. The plurality of curved sections and the plurality of substantially straight sections are pre-configured within the spring-loaded interconnect such that the flexible cable and a spring compress, relax, and axially travel a predetermined distance when at least one external load is applied to at least one end of the spring-loaded interconnect.

20 Claims, 11 Drawing Sheets

(56) References Cited

U.S. PATENT DOCUMENTS

| | | | | |
|---|---|---|---|---|
| 7,315,176 | B2 * | 1/2008 | Nelson | G01R 1/06722 324/755.05 |
| 7,909,613 | B2 | 3/2011 | Lee et al. | |
| 7,922,529 | B1 | 4/2011 | Meurer | |
| 9,160,096 | B2 | 10/2015 | Morley | |
| 2003/0082942 | A1 | 5/2003 | Wlos | |
| 2012/0309226 | A1 | 12/2012 | Orner | |
| 2021/0367384 | A1 * | 11/2021 | Kisling | H01R 24/54 |

FOREIGN PATENT DOCUMENTS

| | | | |
|---|---|---|---|
| JP | 2002-501289 | A | 1/2002 |
| WO | 2011/063373 | A2 | 5/2011 |

* cited by examiner

SPRING-LOADED INTERCONNECTS HAVING PRE-CONFIGURED FLEXIBLE CABLE

CROSS-REFERENCE TO RELATED APPLICATION

This application claims the benefit of priority under 35 U.S.C. § 119 of U.S. Provisional Application Ser. No. 63/029,233, filed May 22, 2020, the content of which is relied upon and incorporated herein by reference in its entirety.

BACKGROUND

The present disclosure generally relates to spring-loaded interconnects, and particularly spring-loaded interconnects having pre-configured flexible cables.

Due to their favorable electrical characteristics, coaxial cables and interconnects/connectors have grown in popularity for interconnecting electronic devices and peripheral systems. In some configurations, an interconnect can be mounted to a circuit board of an electronic device at an input/output port of the device and extended through an exterior housing of the device for connection with a coaxial cable. The interconnects/connectors include a conductive center contact coaxially disposed within an outer conductor, with a dielectric material separating the inner and outer conductors.

A typical application utilizing coaxial cable connectors/interconnects is a radio-frequency (RF) application having RF connectors designed to work at radio frequencies in the UHF, VHF, and/or microwave range. RF connectors are typically used with coaxial cables and designed to maintain the shielding that the coaxial design offers. Some interconnects/connectors include machined center contacts, which extend almost the entire length of the spring-loaded interconnect.

Unfortunately, these lengthy center contacts are often very difficult to manufacture. During manufacture, the center contacts are frequently processed, using various types of wet machining processes, which are capable of stressing the center contacts and causing damage. Assembly of long machined center contacts can also make overall assembly of the interconnects/connectors difficult.

For these reasons, among others, there is a clear need for improved spring-loaded connectors/interconnects.

SUMMARY

Embodiments disclosed herein are directed to spring-loaded interconnects capable of extending to lengths longer than typical connectors/interconnects, having machined center contacts. Because flexible cables are readily available in lengths of several hundred feet, the overall lengths of the spring-loaded interconnects are only limited by ease of assembly.

According to one aspect, a spring-loaded interconnect includes a forward interconnect subassembly, a rearward interconnect subassembly, and a flexible cable extended between each subassembly. The forward interconnect subassembly includes a forward housing and a forward center conductor coupled to the forward housing. The rearward interconnect subassembly is coupled to the forward interconnect subassembly and includes a spring, a rearward housing coupled to the spring, and a rearward center conductor coupled to the rearward housing. The flexible cable is coupled to and positioned between the forward housing and the rearward housing and routed through the spring and the flexible cable. The flexible cable includes at least a center cable conductor with a first cable conductor end and a second cable conductor end opposing the first cable conductor end, a plurality of curved sections, and a plurality of substantially straight sections integral with the plurality of curved sections. The plurality of curved sections and the plurality of substantially straight sections are pre-configured within the spring-loaded interconnect such that the flexible cable and the spring compress, relax, and axially travel a pre-determined distance when at least one external load is applied to one or both ends of the forward housing and the rearward housing, with each external loads ranging from about ten (10) pounds to about fifteen (15) pounds.

BRIEF DESCRIPTION OF THE DRAWINGS

The accompanying drawings are included to provide a further understanding and are incorporated in and constitute a part of this specification. The drawings illustrate one or more embodiment(s), and together with the description serve to explain the principles and operation of the various embodiments.

The figures are not necessarily to scale. Like numbers used in the figures may be used to refer to like components. However, it will be understood that the use of a number to refer to a component in a given figure is not intended to limit the component in another figure labeled with the same number.

DETAILED DESCRIPTION

Various exemplary embodiments of the disclosure will now be described with particular reference to the Drawings. Exemplary embodiments of the present disclosure may take on various modifications and alterations without departing from the spirit and scope of the disclosure. Accordingly, it is to be understood that the embodiments of the present disclosure are not limited to the described exemplary embodiments, but are to be controlled by the limitations set forth in the claims and any equivalents thereof.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower," "upper," "beneath," "below," "above," and "on top," if used herein, are utilized for ease of description to describe spatial relationships of an element(s) to another. Such spatially related terms encompass different orientations of the device in use or operation in addition to the particular orientations depicted in the figures and described herein. For example, if an object depicted in the figures is turned over or flipped over, portions previously described as below or beneath other elements would then be above those other elements.

Cartesian coordinates may be used in some of the Figures for reference and are not intended to be limiting as to direction or orientation.

For purposes of description herein, the terms "upper," "lower," "right," "left," "rear," "front," "vertical," "horizontal," "top," "bottom," "side," and derivatives thereof, shall relate to the disclosure as oriented with respect to the Cartesian coordinates in the corresponding Figure, unless stated otherwise. However, it is to be understood that the disclosure may assume various alternative orientations, except where expressly specified to the contrary.

Figure 1:
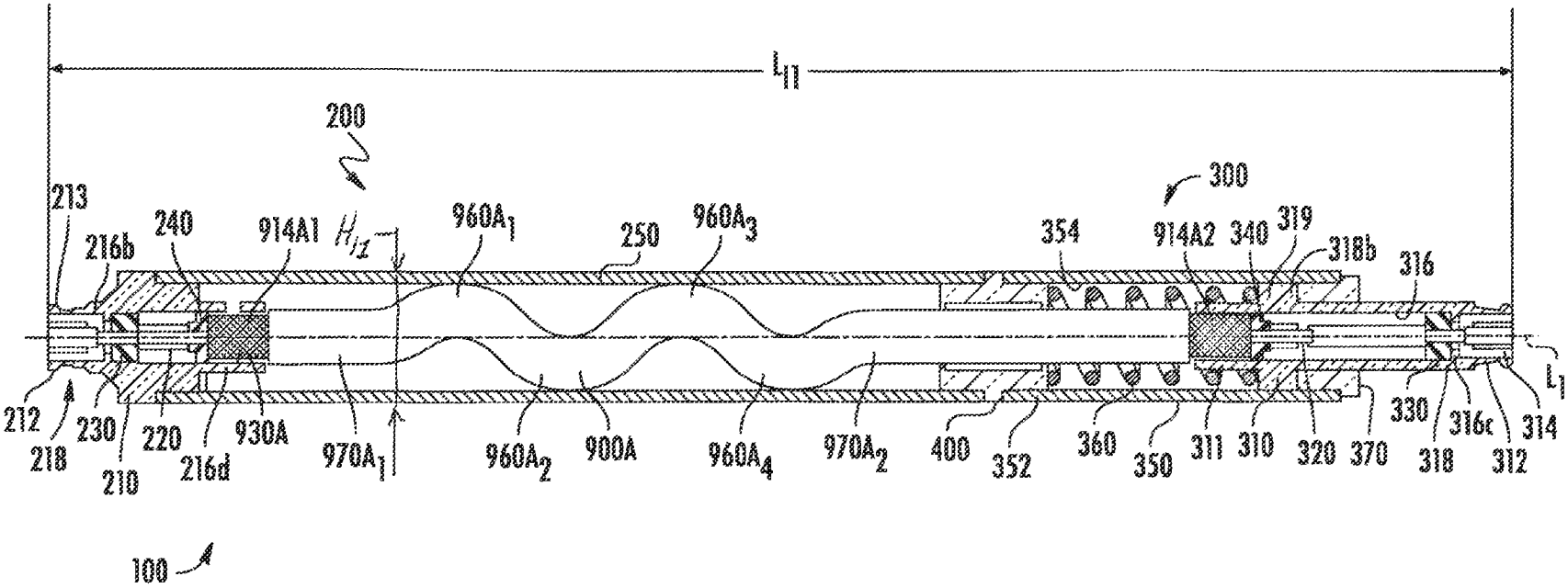
FIG. 1 is a cross-sectional view of a spring-loaded interconnect in accordance with embodiments disclosed herein.
Figure 2:
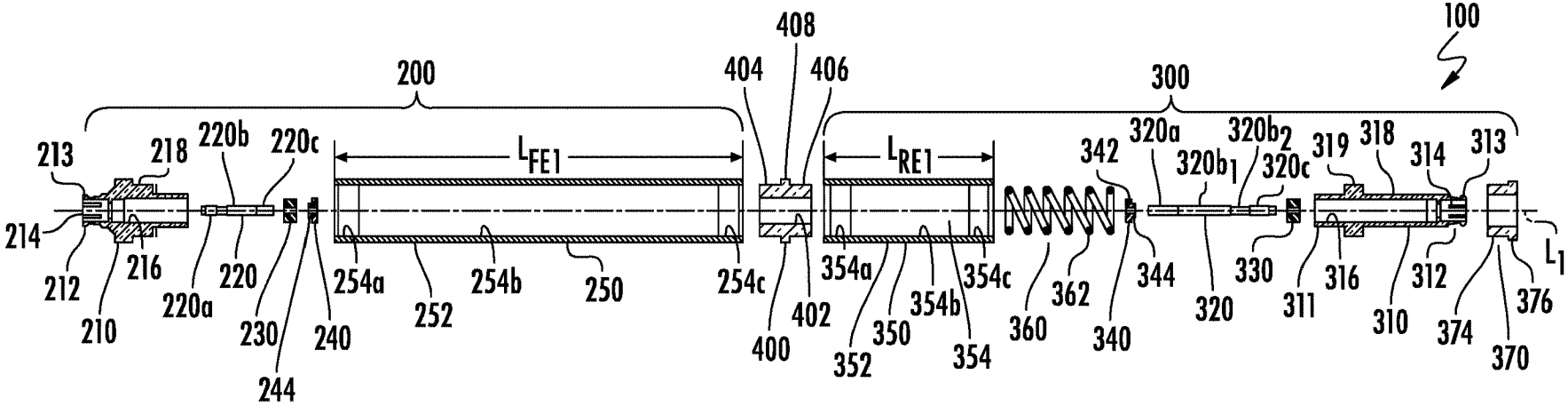
FIG. 2 is an exploded view of the spring-loaded interconnect shown in FIG. 1, excluding the spring shown in FIG. 1.
Figure 7:
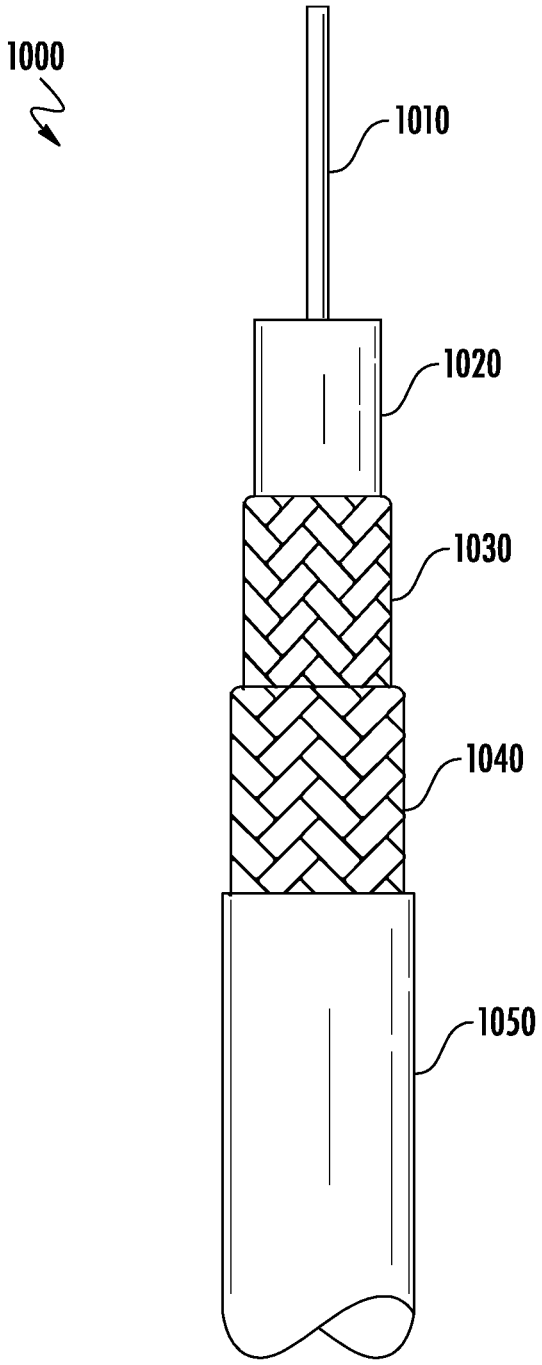
FIG. 7 is a partial cutaway view of an exemplary cable, which may be included in spring-loaded interconnects disclosed herein.

FIGS. 1 and 2 illustrate one embodiment of a spring-loaded interconnect 100. FIG. 1 shows an assembled view of the interconnect 100, while FIG. 2 shows an exploded view of the interconnect 100, with the latter view excluding a pre-configured flexible cable 900A. Where the term "pre-configured flexible cable" refers to cable types that have at least one curved section when installed within a connector assembly. Exemplary cable types for all embodiments include, but are not limited to STORM FLEX® cables, manufactured by Teledyne Storm Microwave, including but not limited to STORM FLEX® 047, 086, and 141 cables. These cable types include silver-plated copper-clad steel center conductors, polytetrafluoroethylene (PTFE) dielectrics, silver-plated copper braided or helically-wrapped silver-plated copper foil layers, silver-plated stainless steel braided layers, and fluorinated ethylene propylene (FEP) outer jackets. One exemplary cable type is shown in FIG. 7, as will be further described.

Referring to FIG. 2, the interconnect 100 includes two interconnect subassemblies—a forward interconnect subassembly 200 (See also FIG. 3A) and a rearward interconnect subassembly 300 (See also FIG. 3B), separated by a junction element 400. Referring back to FIG. 1, the pre-configured flexible cable 900A extends through the subassemblies 200, 300 and the junction element 400. The respective subassemblies 200, 300 and the junction element 400 are also preferably in a coaxial arrangement with respect to a longitudinal axis L1, which extends centrally along the overall length $L_{11}$ of the interconnect 100.

Figure 3A:
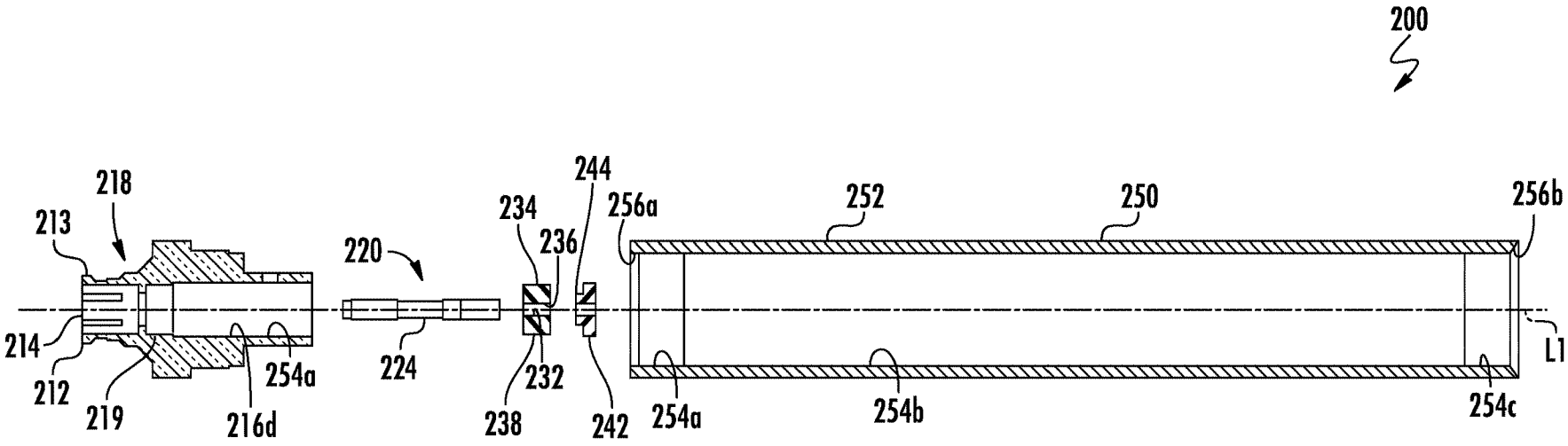
FIG. 3A is an exploded view of a forward interconnect subassembly included in the spring-loaded interconnect shown in FIGS. 1 and 2.

FIGS. 1, 2, and 3A provide additional detail of the forward interconnect subassembly 200. The forward interconnect subassembly 200 includes a forward housing 210, a forward center contact 220, forward dielectrics 230, 240, and a forward exterior housing 250. The forward housing 210 has a first forward housing end 212 with a flange 213 and a plurality of slots 214 (FIG. 3A) extending longitudinally along a portion of the forward housing length. The forward housing 210 also includes a plurality of inner bores 216 and a plurality of outer diameters 218 both having stepped configurations. The plurality of inner bores 216 is configured such that the forward center contact 220 and the forward dielectrics 230, 240 can be positioned within the forward housing 210. One of the plurality of inner bores 216 is configured as a stop element 216*b* such that forward dielectric 230 is adjacent to the stop element 216*b* when the subassembly 200 is assembled, as shown in FIG. 1. The forward dielectric 230 is thus positioned in the assembly to surround a portion of the forward center contact 220.

Referring to FIG. 3A, in this configuration, the plurality of inner bores 216 includes a first end bore 216*a*, the stop element 216*b*, a middle bore 216*c*, and second end bore 216*d*. The plurality of outer diameters 218 includes a first outer diameter 218*a* adjacent the flange 213, a second outer diameter 218*b*, a third outer diameter 218*c*, a fourth outer diameter 218*d*, a fifth outer diameter 218*d*, a sixth outer diameter 218*e*, and a seventh outer diameter 218*f*. The forward housing 210 also includes a first angled surface 219 positioned between the second and third outer diameters 218*b*, 218*c* and a second angled surface 221 positioned between the third and fourth outer diameters 218*c*, 218*d*.

Still referring to FIG. 3A, the forward center contact 220 includes a first forward contact end 220*a*, and a second forward contact end 220*b*, with each end being configured to expand circumferentially. Each end 220*a*, 220*b* can further include a plurality of slots (not shown) that facilitates expansion of the contact ends. The contact 220 includes a middle contact section 220*b* positioned between the contact ends 220*a*, 220*c* and optionally a solder retention feature (not shown) on each end. The first forward contact end 220*a* is open and configured for positioning in the first forward housing end 212. The middle contact section 220*b* is configured such that the forward dielectric 230 surrounds the middle contact portion 220*b* upon assembly. And the second forward contact end 220*c* is open and configured for mating with the pre-configured flexible cable 900A, as will be further described.

As shown particularly in FIG. 3A, both forward dielectrics 230, 240 are configured for positioning within the forward housing 210 such that the forward dielectrics 230, 240 surround respective portions of the forward center contact 220. Each forward dielectric 230 preferably has a cylindrical body 232 with an outer diameter 234, an inner diameter 236, and a dielectric length 238. The inner diameter 236 is such that the forward dielectric 230 surrounds the middle contact portion 220*b* of the center contact 200. Forward dielectric 240 has a flange portion 242 integral with a cylindrical body portion 244. As shown in FIG. 1, the forward dielectric 240 is also preferably configured, upon assembly, to surround the second forward contact end 220*c* and be positioned adjacent to the pre-configured flexible cable 900A.

Referring particularly to FIG. 2, the forward interconnect subassembly 200 also includes a forward exterior housing 250. The forward exterior housing 250 has an outer diameter 252, a plurality of inner bores 254, and a forward exterior housing length $L_{FE1}$. The plurality of inner bores 254 includes a first inner bore 254*a*, a medial bore 254*b*, and a second inner bore 254*c*. The first inner bore 254*a* and the second inner bore 254*c* are preferably larger than the medial bore 254*b*. The first inner bore 254*a* is configured to mate with an outer surface of the forward housing 210, while the second inner bore 254*c* is configured to mate with an outer surface of the junction element 400. As shown in FIG. 3A, the forward exterior housing 250 preferably includes end chamfers 256*a*, 256*b*.

The junction element 400, as shown in FIGS. 1 and 2, is positionable between the forward interconnect subassembly 200 and the rearward interconnect subassembly 300. The junction element 400 includes an inner junction bore 402, outer junction diameters 404, 406 and a junction stop 408. Upon assembly, the junction stop 408 is positioned between the forward exterior housing 250 and the rearward exterior housing 350, as shown in FIG. 1.

Figure 3B:
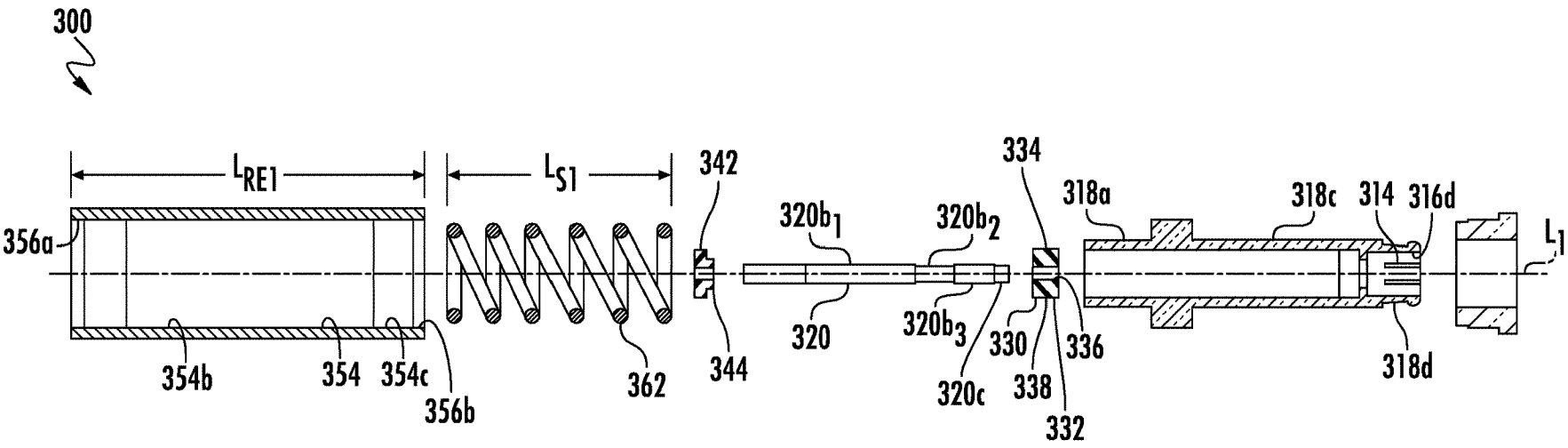
FIG. 3B is an exploded view of a rearward interconnect subassembly included in the spring-loaded interconnect shown in FIGS. 1 and 2.

As shown in FIGS. 1, 2, and 3B, the rearward interconnect subassembly 300 includes a rearward housing 310, a rearward center contact 320, rearward dielectrics 330, 340, a rearward exterior housing 350, a spring 360, and a rearward plug 370. The rearward housing 310 has a first rearward housing end 311, a second rearward housing end 312 with a flange 313 and a plurality of slots 314 extending longitudinally along a portion of the rearward housing length.

As particularly shown in FIG. 3B, the rearward housing 310 also includes a plurality of inner bores 316, and a plurality of outer diameters 318. The plurality of inner bores 316 includes a first inner bore 316*a*, a medial inner bore 316*b*, an inner stop 316*c*, and a second inner bore 316*d*. The plurality of inner bores 316 is configured such that the rearward center contact 320 and the rearward dielectrics 330, 340 can be positioned within the rearward housing 310. As shown in FIG. 1, the inner stop 316*c* is configured such that rearward dielectric 330 is adjacent to the stop when the subassembly 300 is assembled. The plurality of outer diameters includes a first outer diameter 318*a*, an exterior stop 318*b*, a second outer diameter 318*c*, and a third outer diameter 318*d*. Upon assembly, the exterior stop 318*b* is adjacent to the spring 360.

Referring to FIG. 1, the rearward center contact 320 has a first rearward contact end 320*a*, medial rearward contact portions 320*b*1, 320*b*2, 320*b*3, and a second rearward contact end 320*c*. The first rearward contact end 320*a* is open and configured for positioning in the first rearward housing end 312 and coupling with an end of the pre-configured flexible cable 900A. The rearward dielectric 330 surrounds medial rearward contact portions 320*b*1, 320*b*2, 320*b*3 upon assembly. And the second rearward contact end 320*c* is open and configured for coupling with a mating connector, as will be further described.

Both rearward dielectrics 330, 340 are configured for positioning within the rearward housing 310 such that the rearward dielectrics 330, 340 surround respective portions of the rearward center contact 320. Rearward dielectric 330 preferably has a cylindrical body 332 with an outer diameter 334, an inner diameter 336, and a dielectric length 338. The inner diameter 336 is such that the rearward dielectric 330 surrounds the middle contact portion 320*b* of the center contact 300. The rearward dielectric 340 has a flange portion 342 integral with a cylindrical body portion 344. The rearward dielectric 340 is also preferably configured, upon assembly, to surround the cable contact end 912A2 and thus be positioned adjacent to the pre-configured flexible cable 900A.

As shown in FIGS. 1, 2, and 3B, the rearward interconnect subassembly 300 also includes the rearward exterior housing 350, the spring 360, and the rearward plug 370. The rearward exterior housing 350 has an outer diameter 352, a plurality of inner bores 354, and a rearward exterior housing length $L_{RE1}$ (FIG. 3B). Referring to FIG. 3B, the plurality of inner bores 354 includes a first inner bore 354*a*, a medial inner bore 354*b*, and a second inner bore 354*c*. The first inner bore 354*a* and the second inner bore 354*c* are preferably larger than the medial bore 354*b*. The first inner bore 354*a* is configured to mate with an outer surface of the rearward housing 310, while the second inner bore 354*c* is configured to mate with an outer surface of the junction element 400. The spring 360 is contained within the rearward exterior housing 350 such that the spring 360 is positioned between the junction element 400 and the exterior stop 319. The spring 360 has a spring length LS1 and a plurality of coils 362, with the number of coils being determined based on the pre-determined travel length of the spring 360 within the interconnect 300. Accordingly, the spring 360 is configured within the interconnect 100 to compress, relax, and travel a pre-determined distance, which may be proportional to the contact length. The rearward plug 370 has an inner plug bore 372 and a stepped outer configuration, including a plurality of outer diameters 374 and a plug flange 376. Preferably, the plurality of outer diameters 374 includes a first plug outer diameter 374*a* and a second plug outer diameter 374*b*.

Figure 3C:
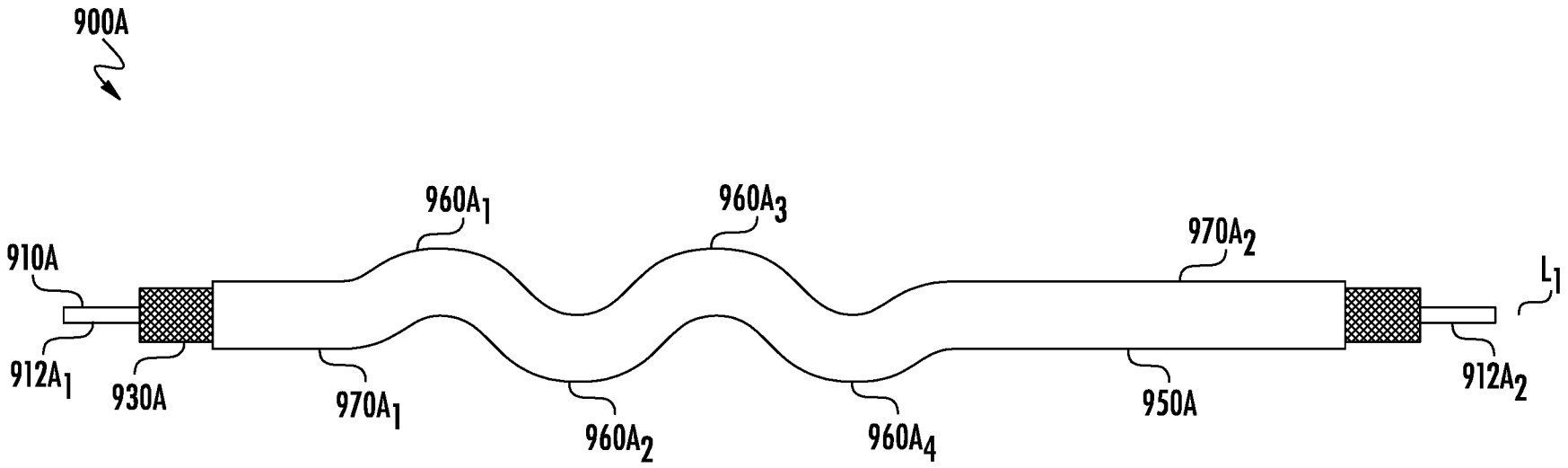
FIG. 3C is a pre-configured flexible cable included in the spring-loaded interconnect shown in FIG. 1.

As shown particularly in FIG. 3C, the cable 900A includes a center cable conductor 910A, having a first cable conductor end 912$A_1$ and a second cable conductor end 912$A_2$, a dielectric (not shown), a conductive braided outer sheath 930A, and an outer jacket 950A. The cable 900A also includes a plurality of pre-configured curved sections 960A and a plurality of pre-configured substantially straight sections 970A integral with the plurality of curved sections 960A. The cable 900A used in the interconnect 100, as shown in FIG. 3C, includes four curved sections 960$A_1$, 960$A_2$, 960$A_3$, 960$A_4$ and two substantially straight sections 970$A_1$, 970$A_2$. However, fewer or more curved sections 960$A_N$ and straight sections 970$A_N$ may be included in the cable 900A. Moreover, one or more of the curved sections may be substantially sinusoidal, as shown, or have multiple variations of bends/curves, which may or may not be substantially sinusoidal. The curved sections 960A may also bend/curve with respect to a centrally located longitudinal axis L1 in a spiral-like fashion. The curved and substantially straight sections of the cable 900A are pre-configured within the interconnect 100 to compress, relax, and travel a pre-determined distance.

To aide in stability of the overall interconnect assembly 100, portions of the subassemblies and the cable can be soldered. For example, upon complete assembly, each end 912A1, 912A2 of the center cable conductor 900A can be inserted into its respective center conductor end 220*b*, 320*a* and exposed portions 914A1, 914A2 of the cable 900A can be soldered respectively to the forward housing end 216*d* and the rearward housing end 311, as shown in FIG. 1. Alternatively, or in addition, each end 912A1, 912A2 of the center cable conductor 900A may be soldered onto its respective center conductor end 220*b*, 320*a*. Specifically, the first cable conductor end 912A1 may be soldered to the second forward contact end 220*b* and the second cable conductor end 912A2 may be soldered to the first rearward contact end 320*a*.

Figure 4:
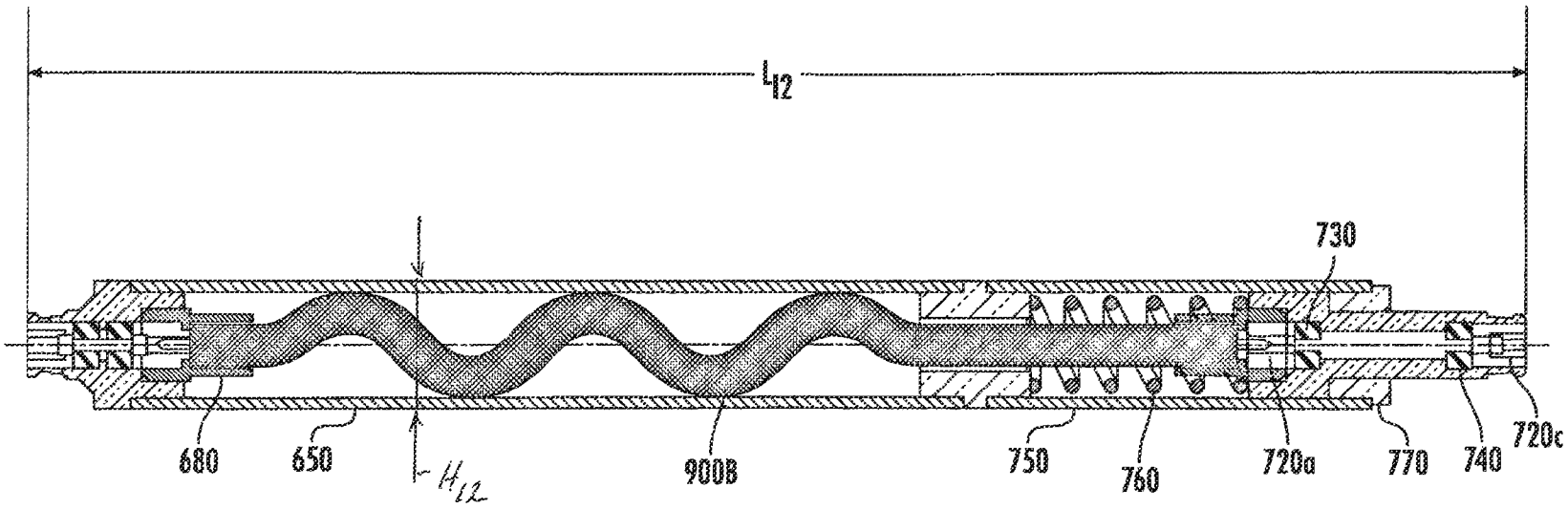
FIG. 4 is a cross-sectional view of a second spring-loaded interconnect in accordance with embodiments disclosed herein.
Figure 5:
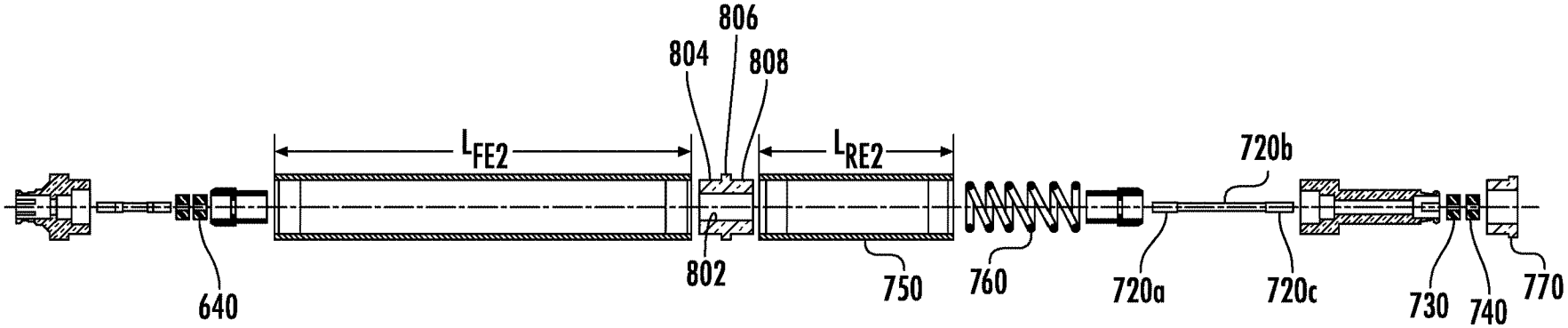
FIG. 5 is an exploded view of the spring-loaded interconnect shown in FIG. 4, excluding the spring shown in FIG. 4.

FIGS. 4 and 5 illustrate another embodiment of a spring-loaded interconnect 500. FIG. 4 shows one version of the assembled interconnect 500, and FIG. 5 shows an exploded view of the interconnect 500, excluding a pre-configured flexible cable 900B. The interconnect 500 includes two subassemblies—a forward interconnect subassembly 600 and a rearward interconnect subassembly 700, separated by a junction element 800. As shown in FIG. 4, the pre-configured flexible cable 900B extends through the subassemblies 600, 700 and the junction element 800. The respective subassemblies 600, 700 and the junction element 800 are also preferably in a coaxial arrangement with respect to a longitudinal axis L2, which extends centrally along the overall length $LI_2$ (FIG. 4) of the interconnect 500.

Figure 6A:
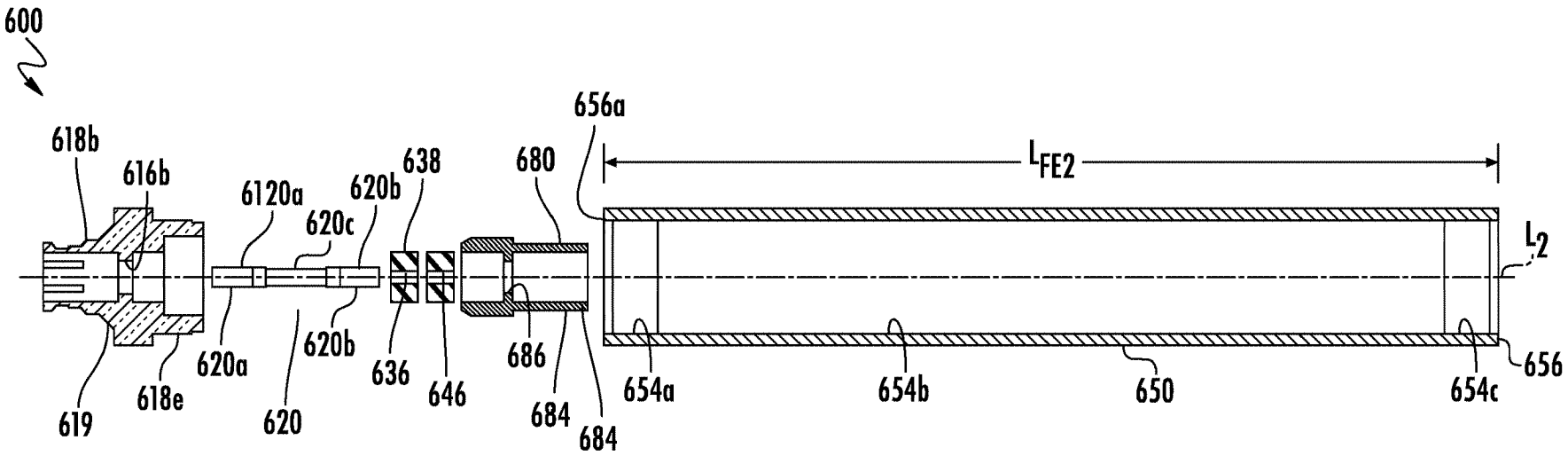
FIG. 6A is an exploded view of a forward interconnect subassembly included in the spring-loaded interconnect shown in FIGS. 4 and 5.

As show in FIGS. 4, 5, and 6A, the forward interconnect subassembly 600 is shown including a forward housing 610, a forward center contact 620, forward dielectrics 630, 640, an insertable forward housing element 680, and a forward exterior housing 650. Referring particularly to FIG. 6A, the forward housing 610 has a first forward housing end 612 with a flange 613 and a plurality of slots 614 extending longitudinally along a portion of the forward housing length. The forward housing 610 also includes a plurality of inner bores 616 and outer diameters 618. The plurality of inner bores 616 is configured such that the forward center contact 620, the forward dielectrics 630, 640, and the forward housing element 680 can be positioned within the forward housing 610. The plurality of inner bores 616 includes a first end bore 616*a*, a stop element 616*b*, a middle bore 616*c*, and a second end bore 616*d*. As shown particularly in FIG. 4, upon assembly, the forward dielectrics 630, 640 are positioned adjacent to the stop element 616*b* upon assembly. The forward dielectrics 630, 640 are thus positioned in the subassembly 600 to surround a portion of the forward center contact 620. The plurality of outer diameters 618 includes a first outer diameter 618*a* positioned adjacent to the flange 613, a second outer diameter 618*b*, a third outer diameter 618*c*, a fourth outer diameter 618*d*, and a fifth outer diameter 618*e*. The forward housing 610 also includes an angled surface 619 positioned between the second and third outer diameters 618*b*, 618*c*.

Still referring to FIG. 6A, the forward center contact 620 includes a first forward contact end 620*a*, and a second forward contact end 620*b*, with each end being configured to expand circumferentially. Each end 620*a*, 620*b* can further include a plurality of slots (not shown) that facilitate expansion of the contact ends. The contact 620 also includes a middle contact section 620*c* positioned between the contact ends 620*a*, 620*b*. The first forward contact end 260*a* is open and configured for positioning in the first forward housing end 612. The middle contact section 620*c* is configured such that dielectrics 630, 640 surround the middle contact portion 620*c* upon assembly. And the second forward contact end 620*b* is open and configured for mating with the pre-configured flexible cable 900B, as will be further described.

Both forward dielectrics 630, 640 are configured for positioning within the forward housing 610 such that the forward dielectrics 630, 640 surround respective portions of the forward center contact 620. Each dielectric 630, 640 preferably has a cylindrical body 632, 642 with an outer diameter 634, 644, an inner diameter 636, 646 and a dielectric length 638, 648. The inner diameter 636 is such that the forward dielectric 630 surrounds the middle contact portion 620*b* of the center contact 600, as shown in FIG. 4. Forward dielectric 640 is also preferably configured, upon assembly, to surround the second forward contact end 620*c* and be positioned adjacent to the pre-configured flexible cable 900B.

As shown particularly in FIG. 6A, the forward interconnect subassembly 600 also includes the forward housing element 680 and the forward exterior housing 650. The forward housing element 680 has a flanged end 682 configured for insertion into the second end bore 616*d* of the forward housing 610 (See also FIG. 4). In addition to the flanged end 682, the forward housing element 680 includes a cylindrical end 684 and a forward housing element step 686. The forward exterior housing 650 has an outer diameter 652, a plurality of inner bores 654, and a forward exterior housing length $L_{FE1}$. The plurality of inner bores 654 includes a first inner bore 654*a*, a medial bore 654*b*, and a second inner bore 654*c*. The first inner bore 654*a* and the second inner bore 654*c* are preferably larger than the medial bore 654*b*. The first inner bore 654*a* is configured to mate with an outer surface of the forward housing 610, while the second inner bore 654*c* is configured to mate with an outer surface of the junction element 800. The forward exterior housing 650 also preferably includes end chamfers 656*a*, 656*b*.

The junction element 800, as shown in FIGS. 4 and 5, is positionable between the forward interconnect subassembly 600 and the rearward interconnect subassembly 700. The junction element 800 includes an inner junction bore 802, junction outer diameters 804, 806 and a junction stop 808. Upon assembly, the junction stop 808 is positioned between the forward exterior housing 650 and the rearward exterior housing 750.

Figure 6B:
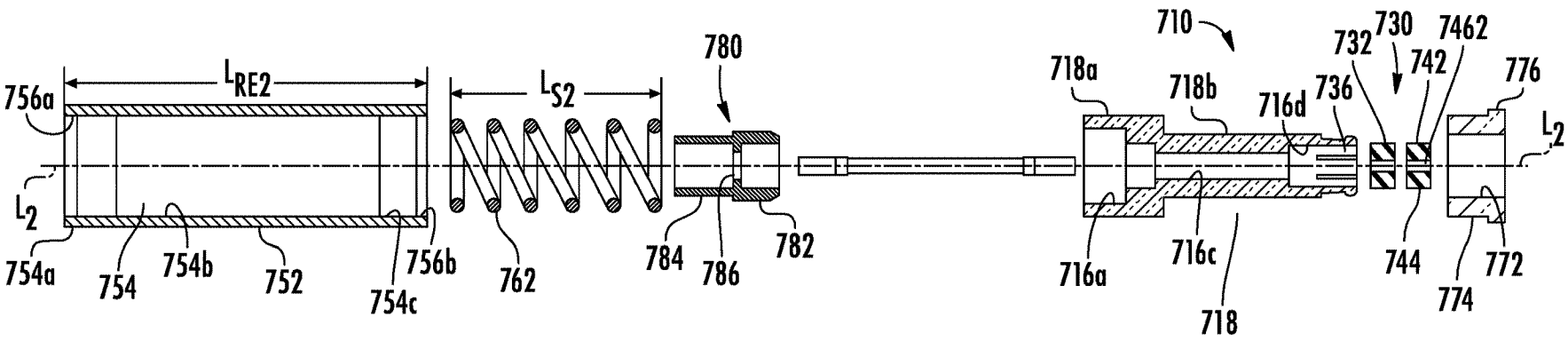
FIG. 6B is an exploded view of rearward interconnect subassembly included in the spring-loaded interconnect shown in FIGS. 4 and 5.
Figure 6C:
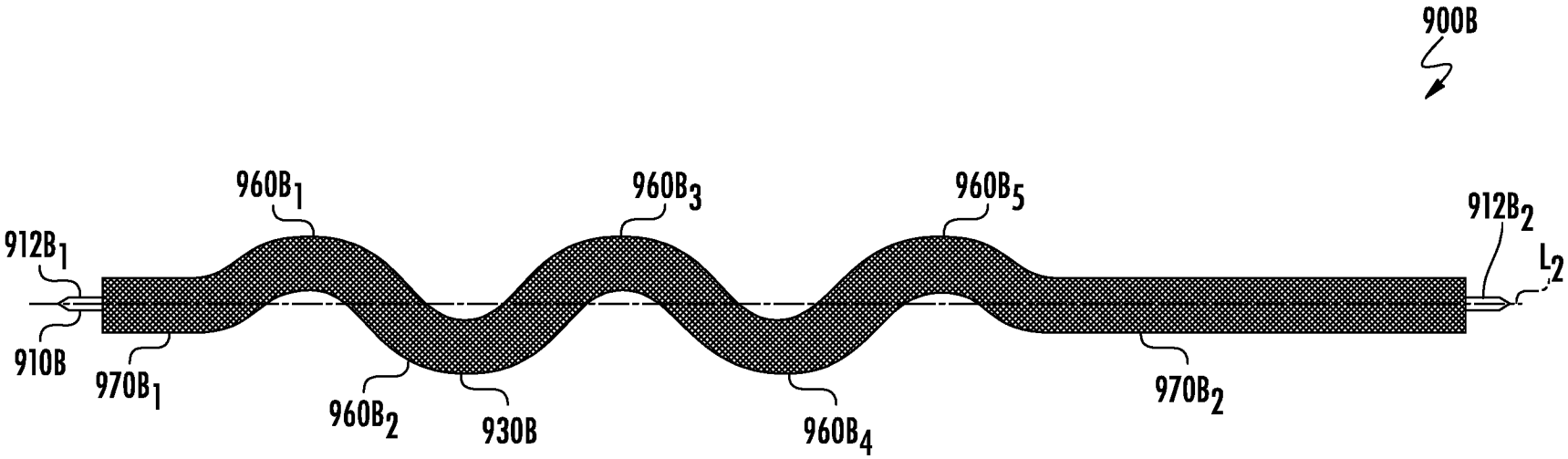
FIG. 6C is a pre-configured flexible cable included in the spring-loaded interconnect shown in FIG. 4.

Referring particularly to FIG. 6B, the rearward interconnect subassembly 700 includes a rearward housing 710, a rearward center contact 720, rearward dielectrics 730, 740, a rearward exterior housing 750, a spring 760, a rearward plug 770, and a rearward housing element 780. The rearward housing 710 has a first rearward housing end 711, a second rearward housing end 712 with a flange 713 and a plurality of slots 714 extending longitudinally along a portion of the rearward housing length $L_{RE2}$ (FIG. 5).

The rearward housing 710 also includes a plurality of inner bores 716, and a plurality of outer diameters 718. The plurality of inner bores 716 includes a first inner bore 716*a*, a second inner bore 716*b*, an third inner bore 716*c*, and a fourth inner bore 716*d*. The plurality of inner bores 716 is configured such that the rearward center contact 720 and the rearward dielectrics 730, 740 can be positioned within the rearward housing 710. The plurality of inner bores is further configured such that rearward dielectrics 730, 740 are disposed within the second inner bore 716*b* and the fourth inner bore 716*d*, with the third inner bore therebetween, as shown particularly in FIG. 4. The plurality of outer diameters includes a first outer diameter 718*a*, a second outer diameter 718*b*, and a third outer diameter 718*c*. Upon assembly, the exterior stop 718*b* is adjacent to the spring 760.

The rearward center contact 720 has a first rearward contact end 720*a*, a middle rearward contact portion 720*b*, and a second rearward contact end 720*c*. The first rearward contact end 720*a* is open and configured for positioning in the first rearward housing end 716 and receiving an end of the pre-configured cable 900B. The middle rearward contact portion 720*b* is configured such that the rearward dielectrics 730, 740 surround the middle rearward contact portion 720*b* upon assembly. The second rearward contact end 720*c* is also open and configured for mating with the mating connector.

Both rearward dielectrics 730, 740 are configured for positioning within the rearward housing 710 such that the rearward dielectrics 730, 740 surround respective portions of the rearward center contact 720. Each rearward dielectric 730, 740 preferably has a cylindrical body 732, 742 with an outer diameter 734, 744, an inner diameter 736, 746 and a dielectric length 738, 748. The inner diameters 736, 736 are such that the rearward dielectric 730, 740 surround the middle contact portion 720*b* of the center contact 700, as shown in FIG. 4.

The rearward interconnect subassembly 700 also includes a rearward exterior housing 750, the spring 760, and a rearward plug 770. The rearward exterior housing 750 has an outer diameter 752, a plurality of inner bores 754, and a rearward exterior housing length $L_{RE2}$. The plurality of inner bores includes a first inner bore 754*a*, a medial bore 754*b*, and a second inner bore 754*c*. The first inner bore 754*a* and the second inner bore 754*c* are preferably larger than the medial bore 754*b*. The first inner bore 754*a* is configured to mate with an outer surface of the rearward housing 710, while the second inner bore 754*c* is configured to mate with an outer surface of the junction element 400. The rearward exterior housing 750 also preferably includes end chamfers 756*a*, 756*b*. Referring to FIG. 4, the spring 760 is contained within the rearward exterior housing 750 such that the spring 760 is positioned between the junction element 400 and the exterior stop 719. The rearward plug 770 has an inner plug bore 772 and a stepped outer configuration, including an outer diameter 774 and a plug flange 776.

As shown particularly in FIG. 6A, the rearward interconnect subassembly 700 also includes the rearward housing element 780. The forward housing element 780 has a flanged end 782 configured for insertion into the end bore 716*a* of the rearward housing 710, as shown in FIG. 4. In addition to the flanged end 782, the forward housing element 780 includes a cylindrical end 784 and a forward housing element step 676 positioned between ends 782, 784.

As shown in FIG. 7, the cable 900B includes a center cable conductor 910B, having a first cable conductor end 912$B_1$ and a second cable conductor end 912$B_2$, a dielectric (not shown), a conductive braided outer sheath 930B, and an outer jacket 950B. The cable 900B also includes a plurality of curved sections 960B and a plurality of substantially straight sections 970B integral with the plurality of curved sections 960B. Referring to FIG. 3C, the cable 900B used in the interconnect 500 includes four curved sections 960$B_1$, 960$B_2$, 960$B_3$, 960$B_4$ and two straight sections 970$B_1$, 970$B_2$. However, fewer or more curved sections 960$B_N$ and straight sections 970$B_N$ may be included in the cable 900B. Moreover, one or more of the curved sections may be substantially sinusoidal, as shown, or have multiple variations of bends/curves. The curved sections may also bend/curve with respect to the centrally located longitudinal axis L2 in a spiral-like fashion. Upon assembly, each end 912$B_1$, 912$B_2$ of the center cable conductor 900B is inserted into its respective center conductor end 620*c*, 720*a* and each exposed portion 914B1, 914B2 of the cable 900B is soldered to the forward housing end 684.

Various cable types can be included in the interconnect assemblies disclosed herein. FIG. 7 illustrates an exemplary flexible cable 1000 that may be used for one or more embodiments of the spring-loaded interconnects disclosed herein. This cable configuration includes a cable center conductor 1010, a cable dielectric 1020, a first braided layer 1030, a second braided layer 1040, and an outer cable jacket 1050.

The spring-loaded interconnects disclosed herein are configured to have lengths that are substantially longer than existing spring-loaded interconnects, particularly those that include machined center contacts. Overall lengths of the spring-loaded interconnects are only limited by ease of assembly. Interconnect lengths can, therefore, be as long as several feet (e.g. up to 12 feet), depending upon material strength and bendability of exterior housings and ease of interconnect assembly.

In some embodiments, the overall interconnect lengths $LI_1$, $LI_2$ can range from about 2 inches to about 7 inches. Spring-loaded interconnects disclosed herein can be further defined with respect to an outermost interconnect diameter $HI_1$ (FIG. 1), $HI_2$ (FIG. 4) to length ratio. In preferred configurations, the outermost interconnect diameters $HI_1$, $HI_s$ range from about 0.065 inches to about 0.070 inches. Accordingly, the outermost interconnect diameter to interconnect length ratio can range from about 0.0325 inches to about 0.010 inches.

It will be apparent to those skilled in the art that various modifications and variations can be made without departing from the spirit or scope of the disclosed embodiments. Since modifications combinations, sub-combinations and variations of the disclosed embodiments incorporating the spirit and substance of the embodiments may occur to persons skilled in the art, the disclosed embodiments should be construed to include everything within the scope of the appended claims and their equivalents.

What is claimed is:

1. A spring-loaded interconnect, comprising:

a forward interconnect subassembly, having a forward housing and a forward center conductor coupled to the forward housing;

a rearward interconnect subassembly, coupled to and opposing the forward interconnect subassembly, having at least one spring, a rearward housing coupled to the spring, and a rearward center conductor coupled to the rearward housing; and a flexible cable, coupled to and positioned between the forward housing and the rearward housing and routed through the spring, the flexible cable, comprising:

a cable center conductor with a first cable conductor end and a second cable conductor end opposing the first cable conductor end, at least one curved section, and a plurality of substantially straight sections integral with the plurality of curved sections, wherein the plurality of curved sections and the plurality of substantially straight sections are pre-configured within the spring-loaded interconnect, wherein the flexible cable and the at least one spring are operative to compress, relax, and axially travel a pre-determined distance when at least one external load is applied to at least one end of the spring-loaded interconnect.

2. The spring-loaded interconnect of claim 1, further comprising a junction element positioned between the first interconnect subassembly and the second interconnect subassembly that joins the first interconnect subassembly and the second interconnect subassembly.

3. The spring-loaded interconnect of claim 2, wherein at least one of the plurality of substantially straight sections extends through the junction element.

4. The spring-loaded interconnect of claim 1, wherein the length of the spring-loaded interconnect ranges from about 2 inches to about 12 feet.

5. The spring-loaded interconnect of claim 1, wherein the length of the spring-loaded interconnect ranges from about 2 inches to about 72 inches.

6. The spring-loaded interconnect of claim 1, wherein the length of the spring-loaded interconnect ranges from about 2 inches to about 60 inches.

7. The spring-loaded interconnect of claim 1, wherein the length of the spring-loaded interconnect ranges from about 2 inches to about 48 inches.

8. The spring-loaded interconnect of claim 1, wherein the length of the spring-loaded interconnect ranges from about 2 inches to about 36 inches.

9. The spring-loaded interconnect of claim 1, wherein the length of the spring-loaded interconnect ranges from about 2 inches to about 24 inches.

10. The spring-loaded interconnect of claim 1, wherein the length of the spring-loaded interconnect ranges from about 2 inches to about 12 inches.

11. The spring-loaded interconnect of claim 1, wherein the length of the spring-loaded interconnect ranges from about 2 inches to about 7 inches.

12. The spring-loaded interconnect of claim 1, wherein the first cable conductor end is disposed in a contact end of the forward center conductor and wherein the second cable conductor end is disposed in a contact end of the rearward center conductor.

13. The spring-loaded interconnect of claim 1, wherein the forward interconnect subassembly further comprises at least one dielectric surrounding the forward center contact.

14. The spring-loaded interconnect of claim 1, wherein the rearward interconnect subassembly further comprises at least one dielectric surrounding the rearward center contact.

15. The spring-loaded interconnect of claim 1, wherein the cable center conductor comprises silver-plating.

16. The spring-loaded interconnect of claim 1, wherein the cable center conductor is silver-plated copper clad.

17. The spring-loaded interconnect of claim 1, wherein the first cable conductor end is soldered to the second forward contact end.

18. The spring-loaded interconnect of claim 1, wherein the second cable conductor end is soldered to the first rearward contact end.

19. The spring-loaded interconnect of claim 1, wherein at least some of the plurality of curved sections are spiraled with respect to a longitudinal axis that extends centrally along the length of the spring-loaded interconnect.

20. The spring-loaded interconnect of claim 1, wherein the spring-loaded interconnect has an outermost interconnect diameter to interconnect ratio ranging from about 0.030 inches to about 0.010 inches.

* * * * *